US009421431B2

(12) United States Patent
Nishio

(10) Patent No.: US 9,421,431 B2
(45) Date of Patent: Aug. 23, 2016

(54) GOLF CLUB HEAD

(71) Applicant: DUNLOP SPORTS CO. LTD., Kobe-shi, Hyogo (JP)

(72) Inventor: Masayoshi Nishio, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/453,743

(22) Filed: Aug. 7, 2014

(65) Prior Publication Data

US 2015/0045145 A1 Feb. 12, 2015

(30) Foreign Application Priority Data

Aug. 8, 2013 (JP) ..... 2013-165643

(51) Int. Cl.
*A63B 53/04* (2015.01)

(52) U.S. Cl.
CPC .... *A63B 53/0466* (2013.01); *A63B 2053/0454* (2013.01); *A63B 2053/0458* (2013.01); *A63B 2053/0462* (2013.01)

(58) Field of Classification Search
CPC ..... A63B 53/0466; A63B 2053/0462; A63B 2053/0458; A63B 2053/0454
USPC ..... 473/342, 345
See application file for complete search history.

(56) References Cited

U.S. PATENT DOCUMENTS

| | | | | |
|---|---|---|---|---|
| 5,755,627 | A * | 5/1998 | Yamazaki | A63B 53/04 473/305 |
| 5,967,904 | A * | 10/1999 | Nagai | A63B 53/04 473/345 |
| 6,669,576 | B1 * | 12/2003 | Rice | A63B 53/02 473/305 |
| 7,530,901 | B2 * | 5/2009 | Imamoto | A63B 53/0466 473/334 |
| 7,575,525 | B2 * | 8/2009 | Matsunaga | A63B 53/0466 473/342 |
| 7,819,758 | B2 * | 10/2010 | Matsunaga | A63B 53/0466 473/345 |
| 8,216,089 | B2 * | 7/2012 | Matsunaga | A63B 53/0466 473/342 |
| 2002/0028715 | A1 * | 3/2002 | Galloway | A63B 53/02 473/342 |
| 2002/0094884 | A1 * | 7/2002 | Hocknell | A63B 53/02 473/334 |

FOREIGN PATENT DOCUMENTS

| | | | |
|---|---|---|---|
| JP | 2005-6698 | A * | 1/2005 |
| JP | 2008-36050 | A | 2/2008 |

* cited by examiner

*Primary Examiner* — Sebastiano Passaniti
(74) *Attorney, Agent, or Firm* — Birch, Stewart, Kolasch & Birch, LLP

(57) ABSTRACT

A golf club head according to the present invention includes a golf club head body that has a crown portion, a sole portion, and a side portion, and has an opening surrounded by the crown portion, the sole portion, and the side portion; and a face portion that blocks the opening of the golf club head body. The face portion is shaped as cup that has a base portion shaped as a flat plate and a peripheral portion that extends from a periphery of the base portion. With respect to the face-back direction, the width of the peripheral portion on the toe side in a plan view is longer than the width of the peripheral portion on the heel side in a plan view.

7 Claims, 8 Drawing Sheets

(a)

(b)

Cross-section along E1

GOLF CLUB HEAD

TECHNICAL FIELD

The present invention relates to a golf club head.

BACKGROUND ART

The heads of wood golf clubs have conventionally undergone many improvements, and in particular, in the case of drivers, various proposals have been made in order to extend the flight-distance. For example, there are heads that employ a face portion that has a so-called cup face construction as disclosed in Patent Literature 1. Specifically, the head is configured by a head body having an opening formed therein and a face portion that blocks the opening of the head body, and a peripheral portion that extends so as to surround the periphery of the opening is formed on the periphery of the face portion. Providing the face portion with such an peripheral portion increases the amount of bending of the face portion when hitting a ball, thus making it possible to obtain the effects of improving restitution performance and extending the flight-distance.

CITATION LIST

Patent Literature

Patent Literature 1: JP 2008-36050A

SUMMARY OF INVENTION

Technical Problem

Extending the flight-distance of a driver requires an improvement in the grabbing of the ball, and consideration has been given to moving the center of gravity of the head to the heel side in order to achieve this. However, if this is done, a new problem arises in that the restitution of the face portion on the toe side decreases. The present invention has been achieved in order to solve the above problems, and an object thereof is to provide a golf club head that can suppress a reduction in restitution performance on the toe side even if the center of gravity of the head is moved to the heel side.

Solution to Problem

A golf club head according to the present invention includes: a golf club head body that has a crown portion, a sole portion, and a side portion, and has an opening surrounded by the crown portion, the sole portion, and the side portion; and a face portion that blocks the opening of the golf club head body, wherein the face portion is shaped as cup that has a base portion shaped as a flat plate and a peripheral portion that extends from a periphery of the base portion, and with respect to a face-back direction, the width of the peripheral portion on a toe side in a plan view is longer than the width of the peripheral portion on a heel side in a plan view.

In the above golf club, the width of the peripheral portion on the toe side in a plan view may be longer than the width of the peripheral portion on the heel side in a plan view by 3 mm or more.

In the above golf clubs, the width of the peripheral portion on the toe side in a plan view may be 6 to 12 mm.

Advantageous Effects of Invention

According to the present invention, the width on the toe side in a plan view is made longer in a peripheral portion provided on a face portion, thus making it possible to increase the amount of bending of the face portion on the toe side when hitting a ball. As a result, it is possible to improve the restitution performance of the face portion on the toe side. For this reason, it is possible to prevent a reduction in the restitution performance on the toe side in a driver even if the center of gravity of the head is moved to the heel side in order to improve the grabbing of the ball, for example.

DESCRIPTION OF EMBODIMENTS

Figure 1:
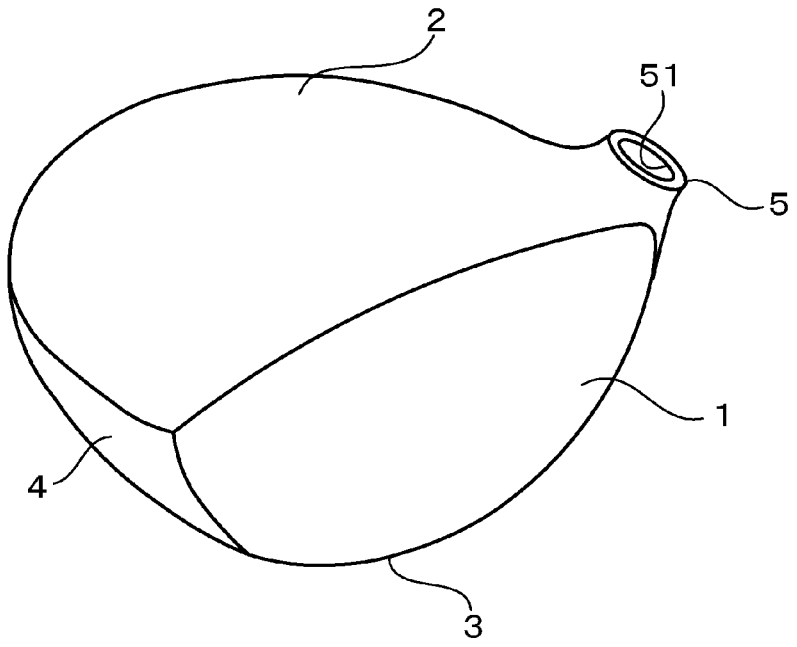
FIG. 1 is a perspective view of a reference state of a golf club head according to an embodiment.
Figure 2:
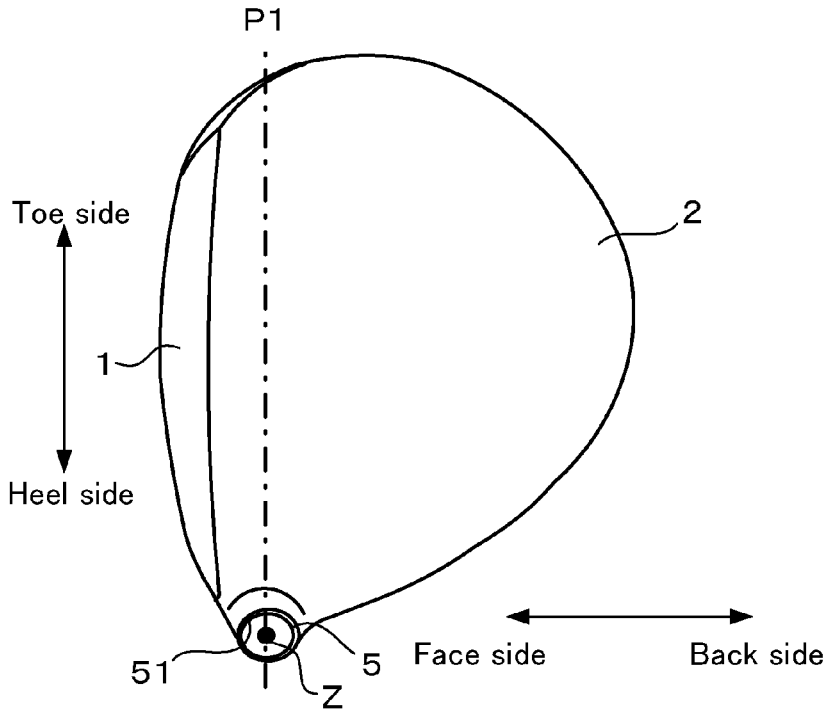
FIG. 2 is a plan view of FIG. 1.

An embodiment of a golf club head according to the present invention will be described below with reference to the drawings. FIG. 1 is a perspective view of a reference state of the golf club head of the present embodiment, and FIG. 2 is a plan view of FIG. 1. Note that the reference state of the golf club head will be described later.

1. Overview of golf club head

As shown in FIG. 1, the golf club head of the present embodiment (hereinafter sometimes simply referred to as the "head") is a hollow structure and has wall surfaces formed by a face portion 1, a crown portion 2, a sole portion 3, a side portion 4, and a hosel portion 5.

The face portion 1 has a face surface, which is the surface for hitting a ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the portion between the crown portion 2 and the sole portion 3, and extends from the toe side of the face portion 1, across the back side of the head, to the heel side of the face portion 1. Furthermore, the hosel portion 5 is the portion provided adjacent to the heel side of the crown portion 2, and has an insertion hole 51 for the insertion of the shaft (not shown) of the golf club. A central axis Z of the insertion hole 51 coincides with the axis of the shaft. Although the head described here is a wood head such as a driver (#1) or fairway wood head, it is not limited to being a wood head, and may be a so-called utility head, hybrid head, or the like.

The following describes the aforementioned reference state. First, as shown in FIGS. 1 and 2, the reference state is defined as a state in which the central axis Z is in a plane P1 that is perpendicular to the ground (horizontal plane), and furthermore the head is placed on the horizontal plane at a predetermined lie angle and real loft angle. The plane P1 will be referred to as the reference vertical plane P1. Also, as shown in FIG. 2, the direction of the line of intersection of the reference vertical plane P1 and the horizontal plane will be referred to as the toe-heel direction, and the direction that is perpendicular to the toe-heel direction and parallel to the horizontal plane will be referred to as the face-back direction.

Figure 3:
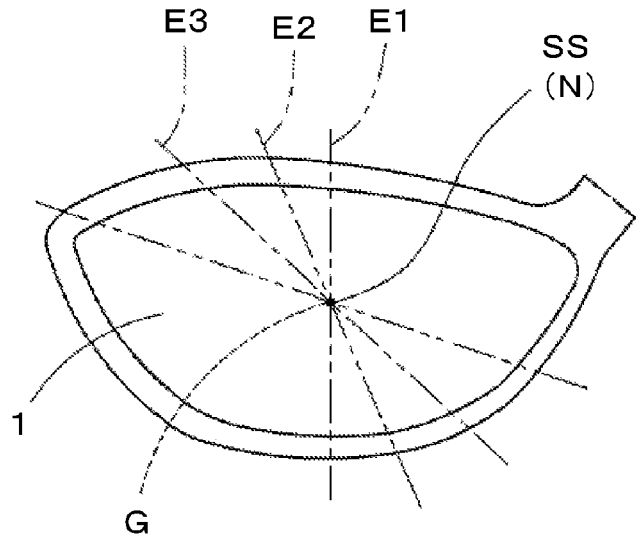
FIGS. 3A and 3B are diagrams illustrating the boundary of a face portion.
Figure 3:
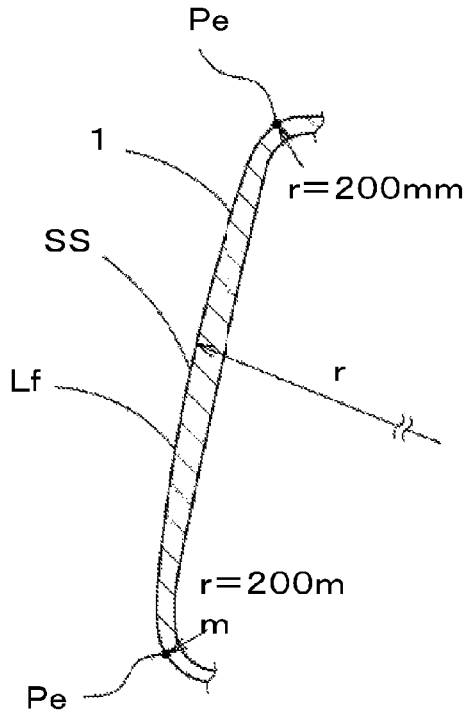

In the present embodiment, the boundary between the crown portion 2 and the side portion 4 can be defined as follows. Specifically, if a ridge line is formed between the crown portion 2 and the side portion 4, that ridge line serves as the boundary. On the other hand, if a clear ridge line is not formed, the boundary is the outline that is seen when the head is placed in the reference state and viewed from directly above the center of gravity of the head. Similarly, in the case of the boundary between the face portion 1, the crown portion 2, and the sole portion 3 as well, if a ridge line is formed, that ridge line serves as the boundary. However, if a clear ridge line is not formed, the periphery (boundary) of the face portion 1 is defined by positions Pe where, in cross-sections E1, E2, E3, and so on that include a straight line N connecting a head center of gravity G and a sweet spot SS as shown in FIG. 3A, a radius of curvature r of an outline Lf of the outer surface of the face first reaches 200 mm when extending outward from the sweet spot side as shown in FIG. 3B. Note that the sweet spot SS is the point where the normal line (straight line N) of the face surface that passes through the head center of gravity G intersects the face surface.

The volume of this golf club head is, for example, preferably 300 $cm^3$ or more, more preferably 400 $cm^3$ or more, and particularly preferably 420 $cm^3$ or more. Having such a volume is advantageous for the head in terms of increasing comfort when the club is held and also increasing the sweet spot area and the moment of inertia. Note that although an upper limit is not particularly defined for the head volume, practically it is, for example, preferably 500 $cm^3$ or less, or preferably 470 $cm^3$ or less when complying with R&A or USGA rules and regulations.

Also, the head can be formed from a titanium alloy having a specific gravity of approximately 4.4 to 4.5 (Ti—6Al—4V), for example. Besides a titanium alloy, the head can be formed from one or two or more materials selected from among stainless steel, maraging steel, an aluminum alloy, a magnesium alloy, an amorphous alloy, and the like. This golf club head can be created with various methods, and can be manufactured by casting using a known lost-wax precision casting method, for example.

Note that the head of the present embodiment is constituted by assembling the face portion 1 to a head body having the crown portion 2, the sole portion 3, and the side portion 4. The head body has an opening surrounded by the crown portion 2, the sole portion 3, and the side portion 4, and the face portion 1 is attached so as to block this opening. The structure of this face portion 1 will be described in detail below.

2. Structure of Face Portion

Figure 4:
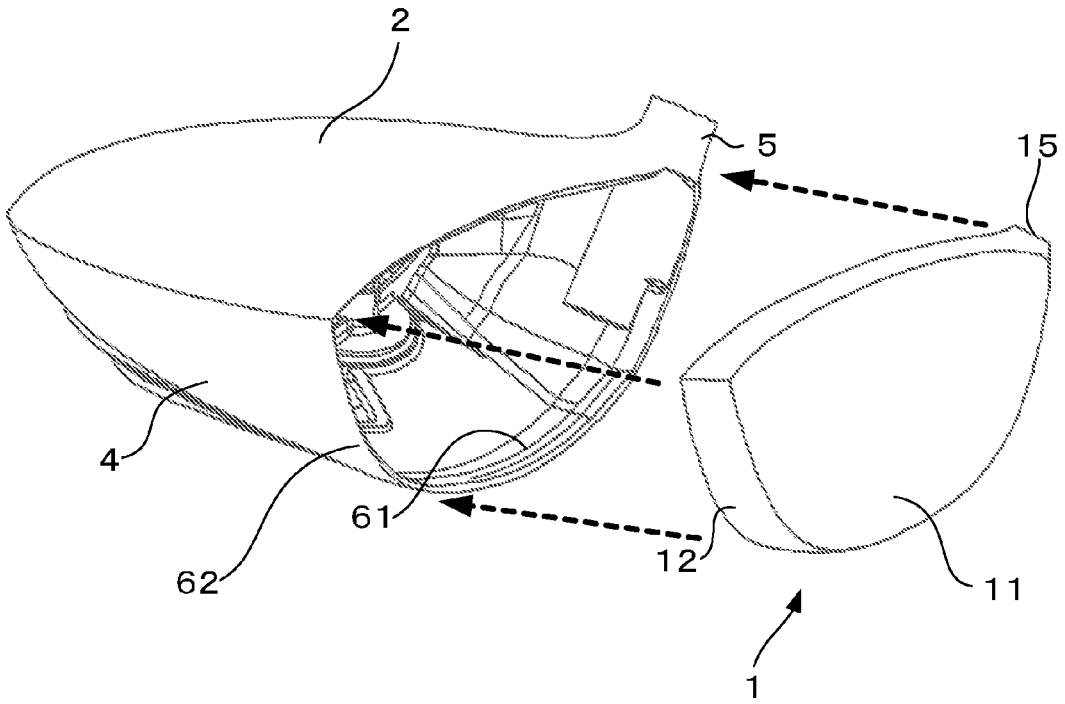
FIG. 4 is a perspective view of the assembly of a head.
Figure 5:
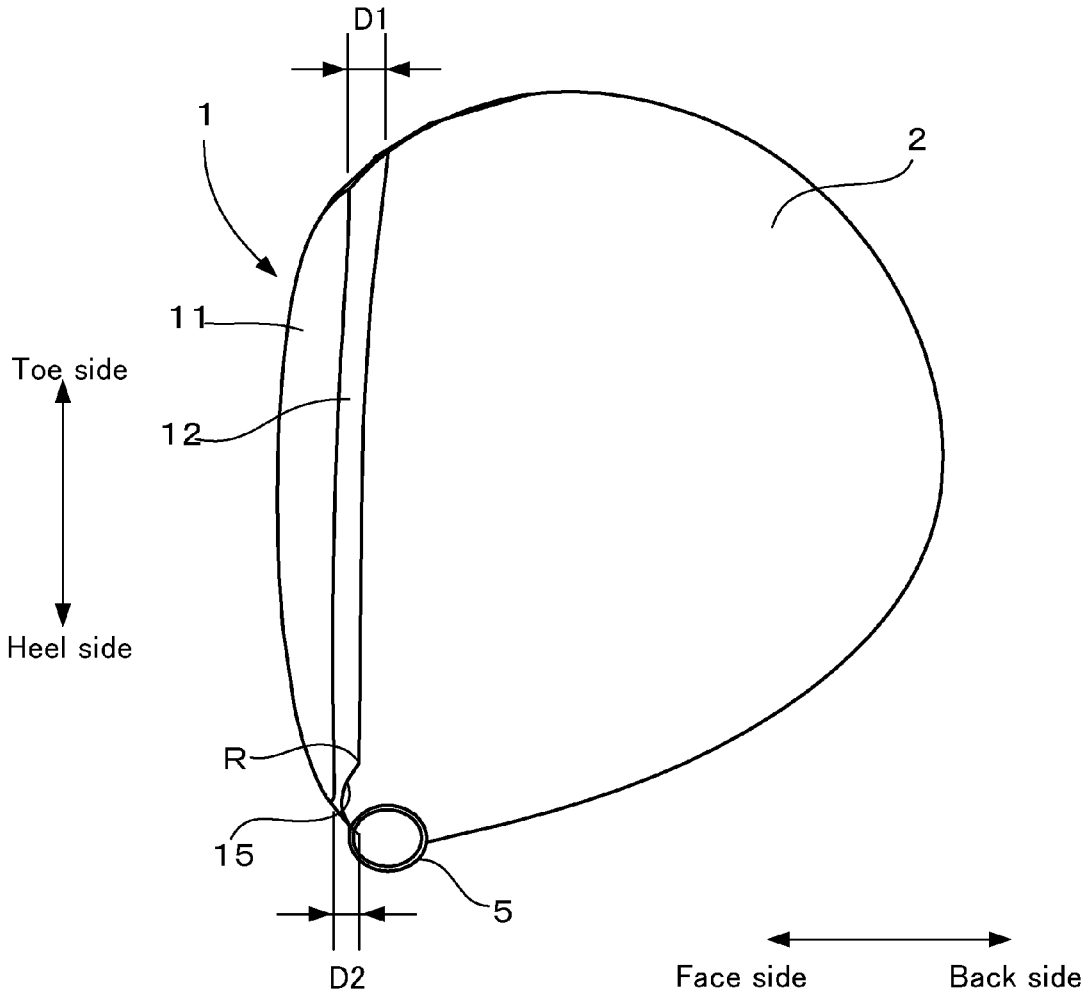
FIG. 5 is a plan view showing a connection portion between a head body and the face portion of the golf club head shown in FIG. 1.
Figure 6:
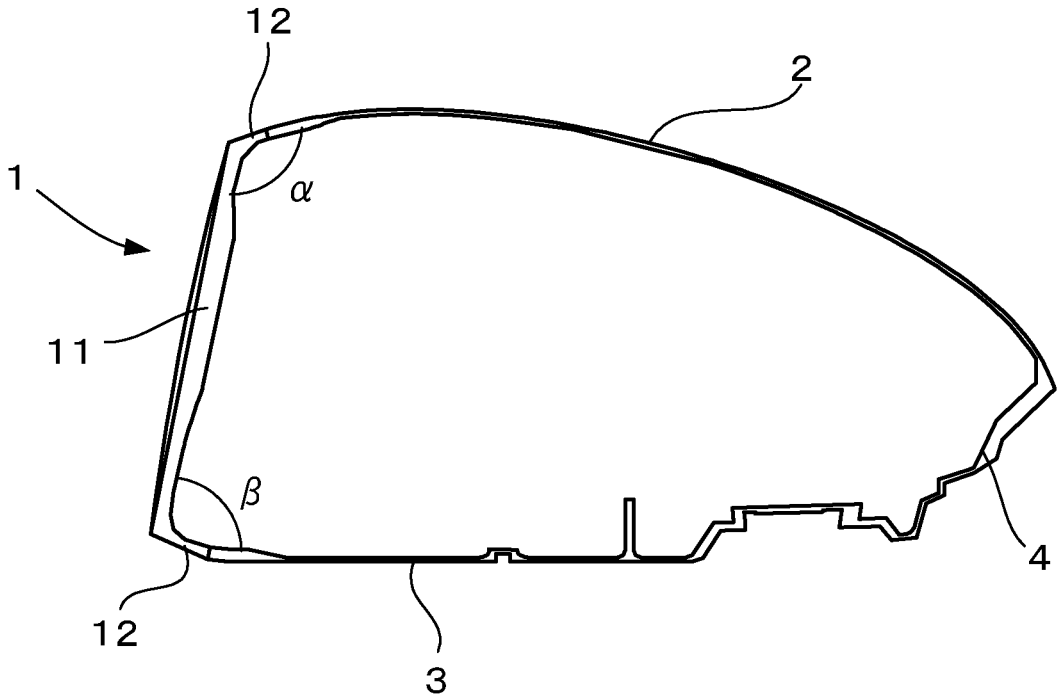
FIG. 6 is a cross-sectional view taken along a line A-A in FIG. 5.

The following describes the face portion 1 with reference to FIGS. 4 to 6 as well. FIG. 4 is a perspective view showing assembly of the head, FIG. 5 is a plan view showing a state of connection between the head body and the face portion in the head in the reference state, and FIG. 6 is a cross-sectional view taken along a line A-A in FIG. 5. As shown in FIG. 4, the face portion 1 is shaped as a cup that has a body portion 11 shaped as a plate and a peripheral portion 12 extending from the periphery of the body portion 11, and the face portion 1 is attached so as to block an opening 61 of the head body. At this time, the peripheral portion 12 is arranged on the outer periphery of the opening 61.

As shown in FIG. 4, the peripheral portion 12 of the face portion 1 is connected so as to be in contact with the outer peripheral portion of the head body that surrounds the opening 61. The outer peripheral portion is a connection region 62 that connects the edges of the crown portion 2, the sole portion 3, and the side portion 4 in a continuous manner, and is formed as a thin region. Accordingly, the peripheral portion 12 of the face portion 1 becomes flush with the crown portion 2, the sole portion 3, and the side portion 4 when it is connected to them.

Also, the peripheral portion 12 of the face portion 1 does not have the same length in all regions. For example, as shown in FIG. 6, an angle $\alpha$ formed by the face portion 1 and the crown portion 2 or the side portion 4 is a roughly obtuse angle, and an angle $\beta$ formed by the face portion 1 and the sole portion 3 is a roughly acute angle, and therefore in order to increase the connection strength, the sole portion 3 side of the peripheral portion 12 of the face portion 1 is longer than the crown portion 2 side and the side portion 4 side. The width of the peripheral portion 12, that is to say the width of contact with the connection region 62, can be set to 4 to 10 mm for example on the sole portion 3 side, and can be set to 3 to 8 mm for example on the crown portion 2 side and the side portion 4 side. Note that in the measurement of the width of the peripheral portion 12 referred to above, the edge of the peripheral portion 12 and the ridge line that is the boundary between the body portion 11 and the peripheral portion 12 are used as references. The same follows in the following description as well.

The following describes the width of the peripheral portion 12 on the toe side and the heel side. As shown in FIGS. 5 and 6, when the head is placed in the reference state, the length of the peripheral portion 12 in the face-back direction differs in a plane view, and a width D1 of the peripheral portion 12 farthest on the toe side is longer than a width D2 of the peripheral portion 12 farthest on the heel side. The width D1 of the peripheral portion 12 on the toe side is preferably 6 to 10 mm, and more preferably 6 to 12 mm. On the other hand, the width D2 of the peripheral portion 12 on the heel side is preferably 3 to 6 mm, and more preferably 3 to 8 mm. Also, the width D1 is preferably longer than the width D2 by 3 mm or more. Note that the widths D1 and D2 of the peripheral portion referred to here are widths in a plane view, and are not widths of actual contact with the connection region 62. It should also be noted that the heel side of the peripheral portion 12 is shaped so as to have a recessed portion 15 so as to not interfere with the hosel portion 5.

Since the width of the peripheral portion 12 is longer on the toe side and shorter on the heel side as described above, the peripheral portion 12 is formed such that its width gradually changes from the toe side to the heel side.

3. Center of Gravity of Head

In the golf club head of the present embodiment, the center of gravity of the head is moved to the heel side in order to improve the grabbing of the ball. The center of gravity can be moved by, for example, providing a weight on the heel side of the sole portion 3. Alternatively, the center of gravity can also be moved by increasing the thickness on the heel side and reducing the thickness on the toe side in at least one of the sole portion 3, the side portion 4, and the face portion 1. This makes it possible to move the center of gravity of the head 1 to 5 mm to the heel side.

4. Features

According to the golf club head of the present embodiment, the width of the peripheral portion 12 provided on the face portion 1 is increased on the toe side in a plan view, thus making it possible to increase the amount of bending of the face portion 1 on the toe side when hitting a ball. As a result, it is possible to improve the restitution performance of the face portion 1 on the toe side. For this reason, it is possible to prevent a reduction in the restitution performance on the toe side in a driver even if the center of gravity of the head is moved to the heel side in order to improve the grabbing of the ball, for example.

5. Variations

Although an embodiment of the present invention has been described above, the present invention is not limited to the above embodiment, and various modifications can be carried out without departing from the gist of the invention. The following are examples of modifications that can be made.

Although the configuration of the face portion 1, and particularly the structure of the peripheral portion 12 of the face portion 1 is described in the above embodiment, there are no particular limitations on the structure of the body portion 11 of the face portion 1. For example, the thickness at the center of the body portion 11 may be increased in order to raise the mechanical strength with respect to impact, but there are no particular limitations on the thickness, including the other regions.

Also, there are no particular limitations on the configuration of the portions other than the face portion 1 as well. In other words, the crown portion 2, the sole portion 3, and the side portion 4 may have any configuration as long as they are configured such that the face portion 1 can be attached. For example, although the thickness of the crown portion 2 is constant in the above embodiment, a thin portion may be formed in a portion of the crown portion 2. This makes it possible to reduce the weight of the crown portion 2. Also, the amount of weight corresponding to the reduction in thickness for weight reduction can be distributed to other portions of the head. This enables improving the degree of freedom in head design. For example, if the above-described weight is distributed to the sole portion 3 of the club head, the center of gravity can be lowered, consequently making it possible to raise the launch angle. Alternatively, if the weight is distributed to the side portion 4, the moment of inertia about the vertical axis passing through the center of gravity of the head can be increased, thus making it possible to improve directionality when hitting a ball.

Working Example

The following describes a working example of the present invention. Note that the present invention is not limited to the following working example.

(1) Preparation of Working Example and Comparative Examples

Figure 7:
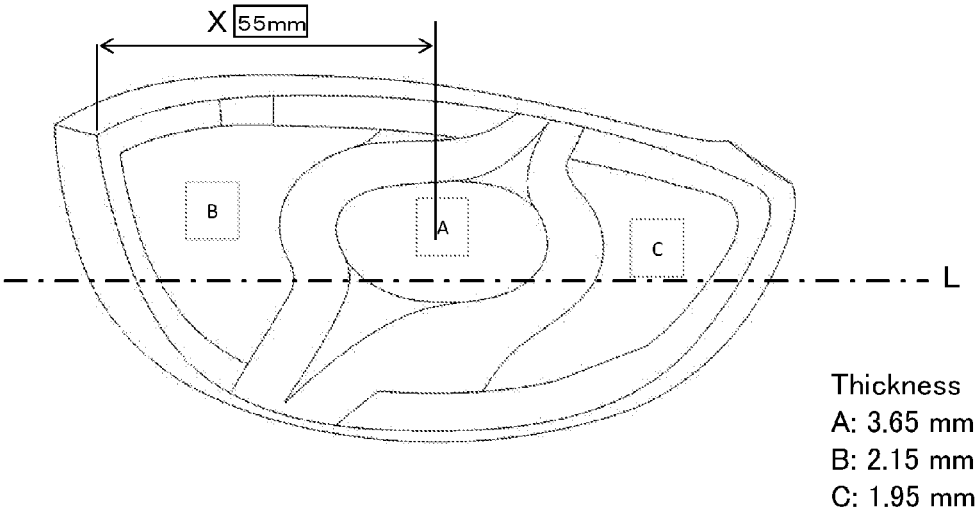
FIG. 7 is a rear view of a face portion according to a working example and a first comparative example.
Figure 8:
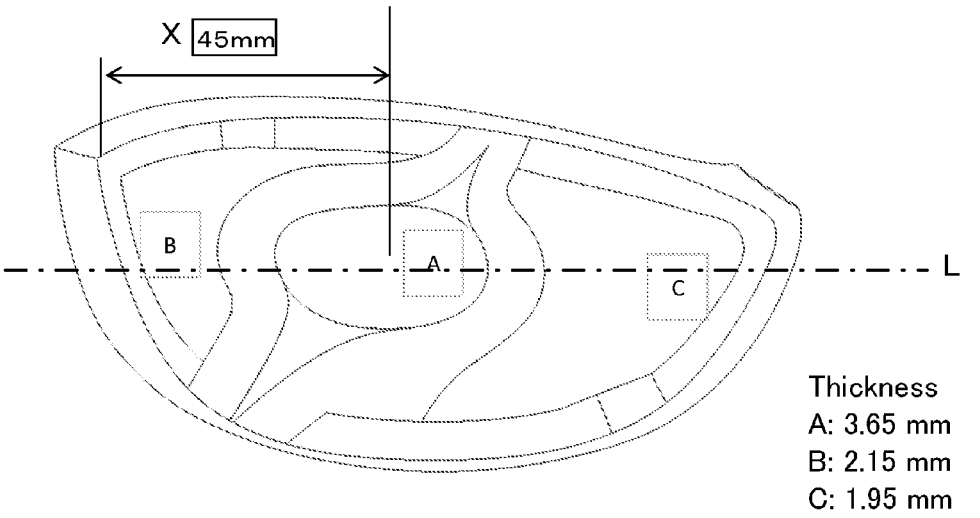
FIG. 8 is a rear view of a face portion according to a second comparative example.
Figure 9:
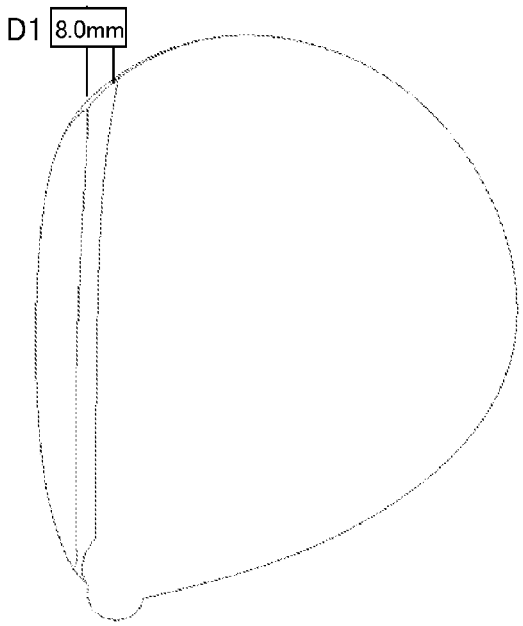
FIG. 9 is a plan view of a head according to the working example.
Figure 10:
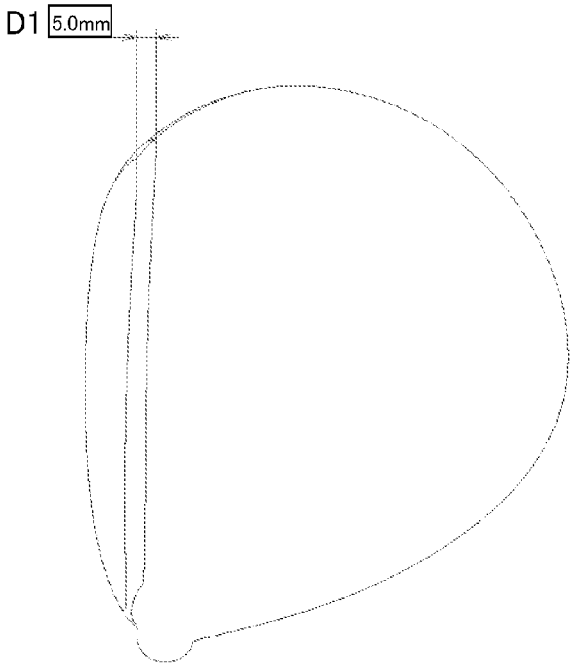
FIG. 10 is a plan view of a head according to the first and second comparative examples.

Here, golf club heads (drivers (#1)) according to one type of working example and two types of comparative examples having different face portion structures were created as shown in Table 1. Regarding the mode of the rear surface of the body portion of the face portion, the mode shown in FIG. 7 was used in the working example and the first comparative example, and the mode shown in FIG. 8 was used in the second comparative example. Specifically, by changing the thickness of the body portion, a length X from the point farthest on the toe side in the boundary between the body portion and the peripheral portion to the center of gravity in the horizontal direction (toe-heel direction) was set differently. Also, regarding the mode of the peripheral portion of the face portion, the mode shown in FIG. 9 was used in the working example. Specifically, the width D1 of the peripheral portion on the toe side in a plan view was 8 mm. On the other hand, the mode shown in FIG. 10 was used in the first and second comparative examples, and the width D1 of the peripheral portion on the toe side in a plan view was 5 mm. Note that the width D2 of the peripheral portion on the heel side (see FIG. 5) was 5 mm in all of the examples. Also, with the exception of the structure of the rear face of the face portion, the working example and the comparative examples were the same as each other. Specifically, each head had a two-piece structure formed by laser-welding a cup-shaped face portion constituted by a hot-forged piece made of TIX-51AF to a head body constituted by a lost-wax precision casted piece made of Ti—6Al—4V. Also, the head volume was 460 $cm^3$, the total surface area of the rear surface of the face portion was 42.0 $cm^2$, and the head mass was 190.5 g. Moreover, the width of the face portion in the toe-heel direction was 107 mm, and the height in the up-down direction was 51 mm. An MP-700 Flex R shaft for drivers made by Dunlop Sports Co., Ltd. was connected as a shaft to the heads created in this way.

Note that in Table 1 below, the center of gravity position X is the length from the point farthest on the toe side in the boundary between the body portion and the peripheral portion to the center of gravity in the horizontal direction (toe-heel direction), and the center of gravity distance refers to the distance along a perpendicular line from an extension line of the central line of the shaft to the center of gravity of the head. Generally, the shorter this center of gravity distance is, the more likely the ball is to be grabbed.

TABLE 1

| | Working example | 1st comparative example | 2nd comparative example |
|---|---|---|---|
| Center of gravity position X (center of gravity distance) | 55 mm (34 mm) | 55 mm (34 mm) | 45 mm (37 mm) |
| Width D1 of peripheral portion on toe side | 8 mm | 5 mm | 5 mm |

The following two tests were carried out on the working example and the first and second comparative examples.

(1) Test Regarding Gripping of Ball

A test was carried out in which ten right-handed players each actually hit five balls, and the flight-distance (carry) and impact point shift were measured and averaged. The impact point shift indicates the amount of shift from the center of the face portion (center in the up-down direction) to the toe side or the heel side along the toe-heel direction. The distance from the center to the impact point was measured with a positive (+) value if the shift was toward the heel side and a negative (−) value if the shift was toward the toe side. The results are shown in Table 2 below.

TABLE 2

| | Working example | 1st Comparative example | 2nd Comparative example |
|---|---|---|---|
| Flight-distance (yard) | 201.0 | 194.8 | 193.3 |
| Shift (mm) | −0.4 | −0.5 | +5.9 |

According to the above results, in the working example and the first comparative example, the center of gravity was shifted to the heel side, and the impact point shift was slightly shifted to the toe side. On the other hand, it can be seen that there was a large shift to the heel side in the second comparative example. It can therefore be seen that grab was improved in the working example and the first comparative example since the ball was grabbed on the toe side. On the other hand, it can be seen that grab was poor in the second comparative example since the ball was grabbed on the heel side. These results appear in the flight-distance, and a comparison of the first comparative example and the second comparative example shows that based on ball grip, the flight-distance has been extended in the first comparative example. Also, the flight-distance in the working example has been extended even more than in the first comparative example due to the contribution of not only the center of gravity position, but also the fact that the width D1 of the peripheral portion is longer.

(2) Restitution Performance Test

Figure 11:
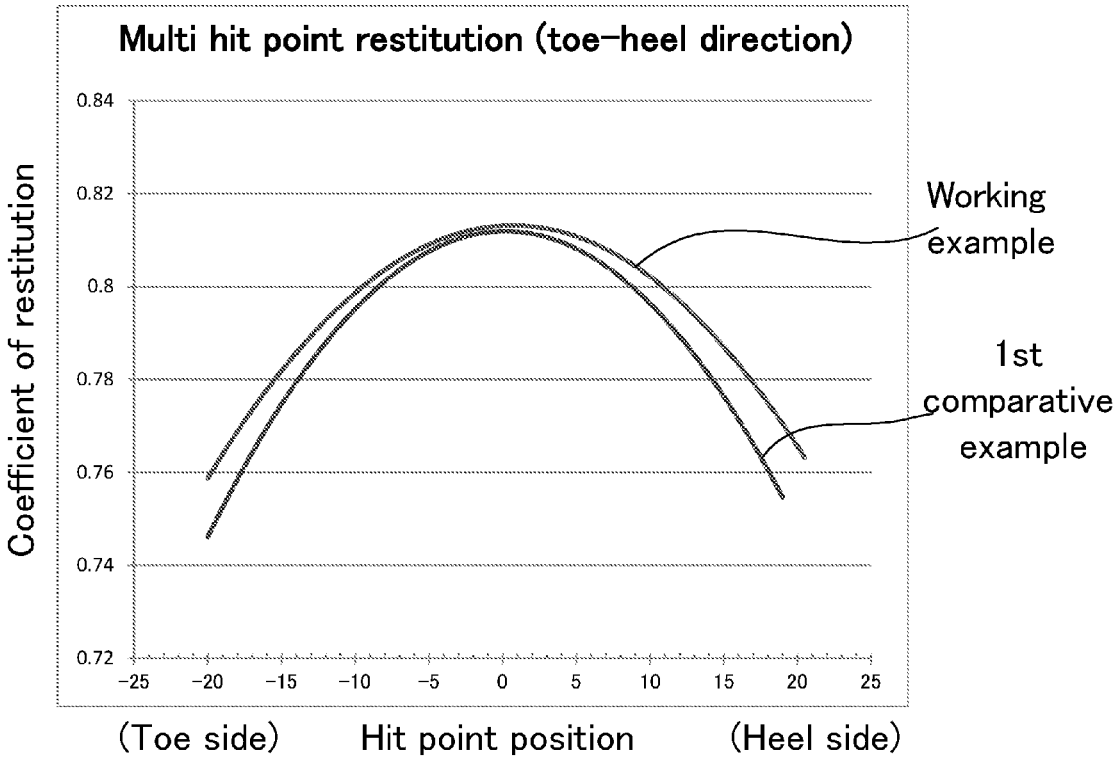
FIG. 11 is a graph showing the coefficient of restitution in the working example and the first comparative example.

The coefficient of restitution was obtained for the working example and the first comparative example in accordance with the U.S.G.A. Procedure for Measuring the Velocity Ratio of a Club Head for Conformance to Rule 4-1e, Revision 2 (Feb. 8, 1999). Measurement was performed at measurement positions on a straight line extending in the toe-heel direction shown in FIGS. 7 and 8, and the graph in FIG. 11 shows the coefficients of restitution obtained at these measurement positions. According to these results, the coefficient of restitution is substantially the same in the central regions of the working example and the first comparative example since they have the same thickness in that region. However, the coefficient of restitution is higher in the toe region and the heel region of the working example. This is thought to be due to the fact that the width of the peripheral portion on the toe side has been increased in the face portion, and the face portion more easily bends. There is also thought to be a further improvement in the effect on the heel side as well due to the movement of the center of gravity to the heel side. According to the above, it is thought that even though the center of gravity position of the working example was the same as in the first comparative example, the flight-distance was increased in the working example as shown in Table 2 due to the improvement in the coefficient of restitution on the toe side and heel side.

REFERENCE SIGNS LIST

1 Face portion
11 Body portion
12 Peripheral portion
2 Crown portion
3 Sole portion
4 Side portion

The invention claimed is:

1. A golf club head comprising: a golf club head body that has a crown portion, a sole portion, and a side portion, and has an opening surrounded by the crown portion, the sole portion, and the side portion; and a face portion that blocks the opening of the golf club head body, wherein the face portion is shaped as cup that has a base portion shaped as a flat plate and a peripheral portion that extends from a periphery of the base portion, and wherein, with respect to a face-back direction, the width of the peripheral portion on a toe side in a plan view is longer than the width of the peripheral portion on a heel side in a plan view, the width of the peripheral portion at the crown portion side increases substantially continuously from the heel side to the toe side, the width of the peripheral portion at the sole portion side increases substantially continuously from the heel side to the toe side, and the entire peripheral portion is substantially forward of a plane P1 passing through an insertion hole for a shaft in said golf club head, said plane P1 being perpendicular to the ground when the sole portion of the golf club head is resting on the ground and said plane P1 extending in a heel-toe direction in the golf club head.

2. The golf club head according to claim 1, wherein the width of the peripheral portion on the toe side in a plan view is 6 to 12 mm.

3. The golf club head according to claim 2, wherein the width of the peripheral portion on the toe side in a plan view is longer than the width of the peripheral portion on the heel side in a plan view by 3 mm or more.

4. The golf club head according to claim 3, wherein the width of the peripheral portion on the heel side in a plan view is 3 to 8 mm.

5. The golf club head according to claim 1, wherein the width of the peripheral portion on the toe side in a plan view is longer than the width of the peripheral portion on the heel side in a plan view by 3 mm or more.

6. The golf club head according to claim 5, wherein the width of the peripheral portion on the heel side in a plan view is 3 to 8 mm.

7. The golf club head according to claim 1, wherein the width of the peripheral portion on the heel side in a plan view is 3 to 8 mm.

* * * * *